US005680877A

United States Patent [19]

Edstrand et al.

[11] Patent Number: 5,680,877

[45] Date of Patent: Oct. 28, 1997

[54] SYSTEM FOR AND METHOD OF CLEANING WATER DISTRIBUTION PIPES

[75] Inventors: Craig Edstrand; Myron Shenkiryk, both of Phoenix, Ariz.

[73] Assignee: H.E.R.C. Products Incorporated, Phoenix, Ariz.

[21] Appl. No.: 547,099

[22] Filed: Oct. 23, 1995

[51] Int. Cl.[6] ..... B08B 9/06

[52] U.S. Cl. ..... 134/103.1; 134/169 C; 134/166 C

[58] Field of Search ..... 134/103.1, 166 C, 134/169 C, 167 C, 166 R, 168 R, 169 R, 22.12

[56] References Cited

U.S. PATENT DOCUMENTS 1,892,093 12/1932 Battistella .
3,667,487 6/1972 Schoenbeck et al. .
5,360,488 11/1994 Hieatt et al. .

*Primary Examiner*—Frankie L. Stinson

*Attorney, Agent, or Firm*—Wood, Herron and Evans, L.L.P.

[57] ABSTRACT

A method of and system for cleaning and maintaining water distribution pipes which have reduced flow due to an increase of water scale deposits, sediment and the like along the inside surface of the pipe includes a mobile cleaning unit which can be conveniently and easily connected to a pipe section to be cleaned. An aqueous cleaning solution is introduced and circulated in a first direction through the pipe section for sufficient time to dissolve and loosen scale and sediment. The flow direction of the treating solution is then reversed to break off or remove sediment or other tuberculated growth that has developed directionally with the direction of water flow in the pipe section. The turbulent flow in the opposite direction increases the effectiveness of the cleaning process in particularly troublesome and hard-to-clean pipe sections. The spent treating solution and other deposits are flushed from the pipe and the mobile cleaning unit to an appropriate waste stream. Advantageously, the direction of the flow of the treating solution can be reversed without disconnecting the cleaning unit from the pipe section.

16 Claims, 3 Drawing Sheets

SYSTEM FOR AND METHOD OF CLEANING WATER DISTRIBUTION PIPES

BACKGROUND OF THE INVENTION

It is well known that the hardness of and suspended solids in the water of commercial, residential and industrial water sources vary widely depending on the source and will result in scale deposition and sedimentation on surfaces wherever the water is used. Scale deposition and sedimentation are particularly troublesome in water distribution pipe systems which service the residential and commercial customers of municipalities, private water companies and the like along with industrial process water distribution pipe systems or networks as found in mining, petroleum, agricultural and the like industries. In such water distribution systems, the formation of scale and sediment can reduce the water flow through the pipe system which will limit the capacity of the pipe to service the requirements of the customers or to provide the required water necessary for an industrial process, irrigation, or the like. For instance, an increased fire hazard would result if the fire hydrants connected to a municipal water system did not supply sufficient water to extinguish the fire due to scale and sediment deposits in the feed pipe line. Ultimately, the water distribution pipe would have to be replaced due to the restrictions created by the scale and sediment deposits which is very costly and entails a prolonged interruption of service.

Additionally, scale and sedimentation will increase the possibility of corrosion in the water distribution pipe along with promoting the growth of bacteria and other organisms. Bacteria and other organisms can be a health hazard and promote corrosion and bio-mass which bind scale and sediment together on the surfaces of the pipes in the system. Corrosion eventually leads to leakage of the pipes in the system and the necessity to replace the leaking sections.

Strong acids have been used to clean water wells; however, submersible pumps in the wells have to be removed prior to treatment to prevent corrosion by the acids employed during the cleaning process. Also, organic acids, mixtures of mineral acids and other compositions have been found to clean water wells without the necessity of removing the pumps or other equipment. These methods for cleaning water wells have involved static and surging treatment.

A proper cleaning and maintenance program for water distribution systems will prevent decreased water flow capacity, corrosion and the necessity to replace the system or portions thereof. One method for cleaning water distribution pipes is disclosed in U.S. Pat. No. 5,360,488 which is assigned to the assignee of this invention and hereby incorporated by reference. The method disclosed in that patent includes introducing an aqueous acidic cleaning solution into a pipe section to be treated and circulating the cleaning solution for a sufficient time to dissolve and loosen the scale and sediment. The spent treating solution containing the dissolved and suspended scale and sediment is then flushed from the pipe section to provide a cleaned pipe with improved water flow.

While the method disclosed in U.S. Pat. No. 5,360,488 has proven to be adequate for many applications, the cleaning effectiveness of that method is minimized in pipes which have an excessively large amount of scale deposits, sediment and the like on the inside of the pipe. Typically, in normal operation water flows in a single direction through a particular pipe section. As a result, tuberculated growth, scale deposits and other sediment inside the pipe develops and accumulates directionally with the direction of water flow in the pipe section. As a result, the cleaning of such pipe sections is particularly difficult and known methods are often ineffective for cleaning and maintaining these systems.

SUMMARY OF THE INVENTION

It has been a primary objective of this invention to provide an effective system and method for cleaning water distribution pipes having scale and sediment deposits therein.

It has been a further objective of this invention to provide such a method and system which is effective for cleaning particularly troublesome deposits and sediment that had developed directionally inside the pipes with the direction of water flow therein.

A still further objective of this invention has been to provide such a method and system which can be easily and efficiently utilized with a minimal amount of labor and out of service time for the pipe section.

It has been a still further objective of this invention to provide such a system in which the major components consist of acid resistant materials which are capable of circulating treating solution for the pipe section over extended periods of time without degradation or failure.

These and other objectives of the invention are achieved by a system for and method of cleaning and maintaining water distribution systems. Such systems having interior scale, sediment deposits and tuberculated growth which may have developed directionally with the direction of water flow in the system are cleaned by introducing an effective amount of an aqueous treating solution into the pipe section to be cleaned and circulating the treating solution in a first direction through the cleaning unit and pipe section. Thereafter, the treating solution is circulated in the pipe section in another direction opposite to the first direction within the pipe section. When the treating solution flow is reversed periodically during the cleaning process, the tuberculated nodules, sediment and other deposits which have formed as a result of water flowing in a single direction through the pipe in use are removed or broken off due to the more turbulent flow in the opposite direction from the flow in which they were formed. Further, periodically reversing the flow of the treating solution enhances the cleaning process by loosening the nodules and deposits and exposing previously unexposed portions thereof which otherwise could not be accessed by flow of the treating solution in a single direction. As a result, water distribution pipes with particularly large sediment deposits or other growth which previously have proven to be particularly troublesome are effectively unclogged and cleaned according to this invention.

Preferably, the system of this invention for cleaning water distribution pipes can be used to reverse the flow of the treating solution within a pipe section to be cleaned without detaching or disconnecting the system from the pipe section. The invention is preferably a closed system for cleaning the pipe section. According to presently preferred embodiments of the invention, diversion valves are provided in the cleaning unit which can be easily reconfigured between discharge and return configurations in order to reverse the flow of the treating solution within the pipe section to be cleaned without disconnecting or removing the cleaning system from the water distribution pipe.

Moreover, major components of this system are fabricated from chemical resistant materials to be able to circulate an appropriate treating solution for extended periods of time including solutions having a pH of approximately zero to fourteen. Further, a presently preferred flanged swivel adapter is included in the system to minimize threaded connections between various components of the system which may be eroded over time by the treating solution. Moreover, the flanged swivel adapter includes a bleed line by which a portion of the solution circulating through the adapter in the system can be bled off and sampled to monitor the pH and other parameters of the treating solution during the cleaning process without interrupting the cleaning process.

The treating solution may be acidic, neutral or basic. In a presently preferred form, mineral acids or organic acids and mixtures thereof are employed as acidic treating solutions. The treating solutions may contain further additives such as inhibitors, chelating agents, penetrating and/or disbursing agents to assist in the removal of scale and sediment and to minimize any adverse effects of the pipes, valves and other system surfaces due to the treating solution employed.

Once the treating solution has been appropriately neutralized, the fluid in the cleaning unit along with the dissolved or suspended scale, sediment and other removed tuberculated growth nodules from the pipe section are flushed from the water distribution system and cleaning unit for appropriate disposal.

This invention provides a simple, low cost, and effective method for removing scale, sediment, and particulate growth which has developed directionally with the direction of water flow within the pipe section in order to maintain proper water flow, operation and to prevent corrosion of the system which could lead to the high cost and inconvenience of replacement. Further, the cleaning process is effective for particularly troublesome applications with a minimal amount of out of service time for the water distribution system and inconvenience by the operators in monitoring and adjusting the components of the system for an effective cleaning process. Further, components of the system are made of chemical resistant materials and designs of construction employed enable use of effective treating solutions for extended periods of time without degradation or failure of the components.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
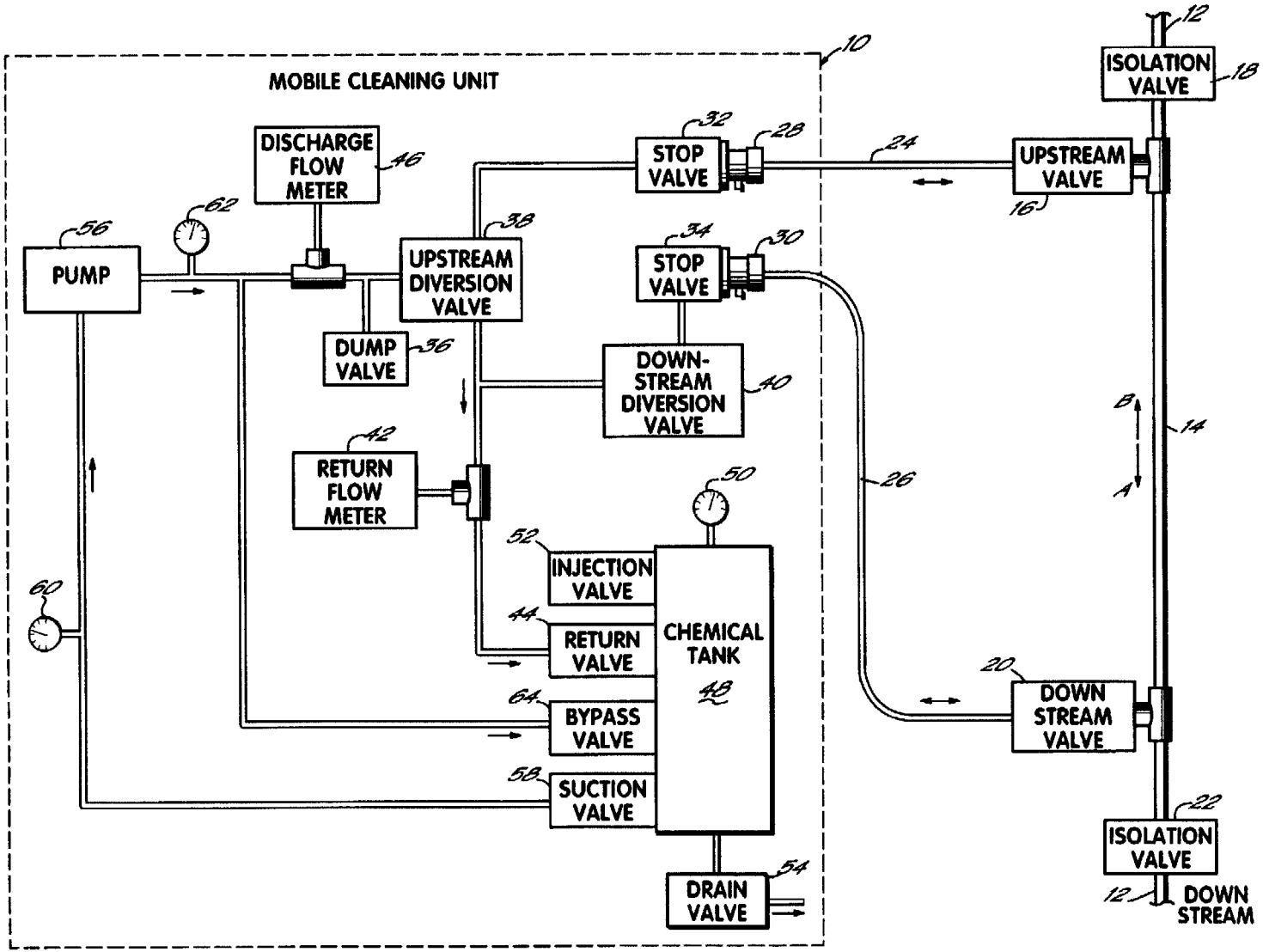
FIG. 1 is a schematic representation of a first presently preferred embodiment of the system for cleaning a pipe section for the water distribution network.

Referring to FIG. 1, a first presently preferred embodiment of a mobile cleaning unit 10 water distribution pipe network 12 is shown. The components of a mobile cleaning unit 10 are shown contained in the dashed lines of FIG. 1 and are preferably mounted upon a flatbed truck (not shown) or the like for convenient transportation and positioning of the mobile cleaning unit 10 proximate a pipe section 14 to be cleaned of the water distribution network 12. A 36×8 foot flatbed goose neck trailer or other comparable vehicle is appropriate to mount the components of the mobile cleaning unit 10 according to this invention. The cleaning unit 10 is positioned at an upstream valve 16 such as a hydrant, tap or the like at an upstream end of the pipe section 14. Upstream of the upstream valve 16 in the water distribution network 12 is an isolation valve 18 which when opened for normal use permits water in the distribution network 12 to flow through the pipe section 14 and when closed isolates the pipe section 14 and blocks water from flowing therein. The pipe section 14 extends between the upstream valve 16 and a downstream valve 20 such as a hydrant, tap or the like, which is positioned upstream from a downstream isolation valve 22 of the water distribution network 12. Typically, the pipe section 14 to be cleaned is approximately a 1200 feet long section of a 6 inch water distribution pipe.

The mobile cleaning unit 10 is initially positioned proximate the upstream valve 16 and an upstream circulation hose 24 is connected to the upstream valve 16 and unwound from a hose reel (not shown) while moving the mobile cleaning unit 10 downstream to approximately the midpoint of the pipe section 14 to be cleaned. The unwound upstream circulation hose 24 is then disconnected from the hose reel on the mobile cleaning unit 10 and the unit 10 is moved to the downstream valve 20. A downstream circulation hose 26 is then connected to the downstream valve 20 and unwound from a hose reel (not shown) while moving the mobile cleaning unit 10 to approximately the midpoint of the pipe section 14. The hose reel assemblies include a disk, drum, axle, self-lining bearings, 12 volt rewind mechanism, motor and frame and are commercially available from Hannay Reels as Model No. EC2645-52VER G. The downstream unwound hose 26 is disconnected from the hose reel and the free ends of the upstream and downstream circulation hoses 24, 26 are connected to upstream and downstream flanged swivel adapters 28, 30, respectively. Each of the adapters 28, 30 are connected to a stop valve 32, 34, respectively. The flanged swivel adapters 28, 30 will be described in detail later herein with reference specifically to FIGS. 3 and 4. The stop valves 32, 34 are each operable between an open and a closed position to permit and prevent, respectively, flow therethrough. The circulation hoses 24, 26 are preferably 100% polyester mill 4 inch discharge hoses, single jacketed with firehose couplings. Such hoses are manufactured by the National Firehose Corporation and approximately 1,200 feet of hose is required for this example of this invention. Within the mobile cleaning unit 10, the various components as described herein are connected by piping, preferably 2, 3 or 4 inch polypropylene schedule 80 pipe with socket fusion couplings.

The downstream stop valve 34 is connected to a dump valve 36 for purging fluid at this point in the mobile cleaning unit 10. The upstream and downstream stop valves 32, 34 are connected to upstream and downstream diversion valves, 38 and 40, respectively. The upstream diversion valve 38 is adjustable between a return flow position from the upstream direction of the pipe network 12 to the mobile cleaning unit 10 and a discharge position from the mobile cleaning unit 10 to the pipe section 14 to be cleaned. Similarly, the downstream diversion valve 40 is operable between a return flow position from the downstream direction of the pipe section 14 to be cleaned and a discharge position from the mobile cleaning unit 10 to the pipe section 14. Preferably, the diversion valves 38, 40 are each three way 3 inch valves with wrench and lock-out capabilities. Such a valve is available from Xomox Corporation as Part No. 031 AX DI/PFA.

The downstream diversion valve 40 of the mobile cleaning unit 10 is connected by piping through a return flow meter 42 to a return valve 44. The upstream diversion valve 38 is connected via piping to a discharge flow meter 46. Each of the flow meters 42, 46 are preferably 3 inch, polyurethane lined, remote type flow meters commercially available from Admag as Model No. AM11 DHD1A and preferably include flow meter sensors (Model No. AM208DN).

The return valve 44 is mounted on a chemical tank 48 which is preferably a 3,000 gallon steel tank measuring approximately 61×96×120 inches having welded baffles and an 18 inch diameter opening. Preferably, the interior of the chemical tank 48 is coated with vinyl ester (TNEMEC, Series 120 Vinester) and the exterior with polyurethane enamel to resist chemical corrosion and degradation of the tank 48 from both the chemicals contained therein and exterior environmental conditions. The tank 48 preferably includes a level indicator 50 which is a two wire, loop powered level measuring ultrasonic transmitter with display operating at 30 kilohertz which is commercially available from Hawk America (Sensor Model No. TD30-06). An injection valve 52 is also coupled to the chemical tank 48 for injecting treating solution and other aqueous based fluids into the chemical tank 48. A drain valve 54 is also provided proximate the bottom of the tank 48 for the discharge of sediment, particulate matter and fluids which remain in the tank 48 after the cleaning process.

A pump 56 is connected via appropriate piping to the chemical tank 48 through a suction valve 58. A suction pressure gauge 60 is provided between the pump 56 and the suction valve 58 on the chemical tank 48. The pump 56 is preferably a horizontal centrifugal pump, glass reinforced vinyl ester construction having a 2.3 liter 63 horsepower Ford industrial gas engine with electric starter. The pump 56 is commercially available from Ingersoll Dresser as Model No. GRP4×3×10 and the engine from Ford as Model No. LSG4231-6007-B, Model Code AX991-02. Output from the pump 56 is directed via piping to the discharge flow meter 46. A discharge pressure gauge 62 is provided at the discharge side of the pump 56. A bypass line connected to a bypass valve 64 on the chemical tank 48 is coupled directly to the pipe exiting the pump 56.

Preferably, each of the valves of the mobile cleaning unit are 1, 2, 3 or 4 inch ball valves of solid graphite construction having an insert constructed with fibers and Ryton. Valves of this type are commercially manufactured by Dresser as NIL-COR-X-310-ST-T-S. In addition, the mobile cleaning unit 10 preferably includes additional water storage tanks (not shown) each having 230 gallon capacity and being polyethylene horizontal leg tanks commercially available from Snyder.

The process for cleaning the pipe section 14 with the mobile cleaning unit 10 according to the presently preferred embodiment shown in FIG. 1 begins with charging the mobile cleaning unit 10 with water from the water distribution network 12 after the upstream and downstream circulation hoses 24, 26 are connected as previously described. To charge the cleaning unit 10 with water, the injection valve 52, drain valve 54 and connected dump valve 36 are closed. The return and suction valves 44, 58 on the chemical tank 48 and the upstream stop valve 32 are all opened and the upstream diversion valve 38 is positioned for return flow from the upstream direction of the water distribution network 12 and the downstream diversion valve 40 is positioned for return flow from the downstream direction and into the cleaning unit 10 from the water distribution network 12. The upstream valve 16 and upstream isolation valve 18 are opened allowing water from the distribution network 12 to flow through the upstream circulation hose 24 and into the mobile cleaning unit valves and piping components and into the chemical tank 48. Once the air in the upstream portion of the mobile cleaning unit 10 is displaced from the piping, valves, and associated components, the upstream stop valve 32 is closed and the downstream valve 20 and stop valve 34 are opened permitting water to flow through the pipe section 14 to be cleaned, displacing the air and filling the downstream circulation hose 26 and flowing through the downstream portion of the mobile cleaning unit valves and piping and into the chemical tank 48. This flow is continued until the desired water level in the chemical tank 48 is achieved and the piping system within the cleaning unit 10 and the pump 56 are full of water at which time the downstream stop valve 34 is closed.

After the cleaning unit 10 is charged with water, the cleaning unit 10 and pipe section 14 to be cleaned are isolated from the network 12 and checked for leaks as follows. The upstream and downstream isolation valves 18, 22 are closed and the upstream diversion valve 38 is positioned as discharge from the cleaning unit 10 to the pipe section 14. The pump 56 is started and circulates water through the cleaning unit 10, and chemical tank 48. The stop valves 32, 34 are opened allowing the water to be circulated from the chemical tank 48 through the upstream stop valve 32, the upstream circulation hose 24 and the pipe section 14 to be cleaned and returning to the cleaning unit 10 through the downstream valve 20, the downstream stop valve 34 and downstream diversion valve 40 which is positioned as return flow from the pipe section 14. The water flows from the downstream diversion valve 40 through the return flow meter 42 and the return valve 44 and into the chemical tank 48. Pressure and flow rates are optimized with the operating pressure being no greater than the normal operating pressure of the pipe section 14 to be cleaned. This is accomplished by adjusting the bypass valve 64 from a fully open position toward a closed position until the desired pressure and flow rates are achieved. By monitoring each percentage of bypass valve 64 closure versus increase in flow rate at the discharge flow meter 46, optimum flow rate is achieved when there is no increase in discharge flow with continued bypass valve 64 closure.

Once optimum flow rates are established in the mobile cleaning unit and pipe section, circulation hoses as well as all valves, flanges and other components of the unit are checked for leakage. Likewise, the chemical tank fluid level is monitored, the fluid pressure entering and discharging from the pump and the flow meters are monitored for changes for a minimum of preferably 30 minutes. If any leakage in the system is detected, circulation is discontinued and appropriate repairs are made and the system is then reevaluated for leakage.

The treating solution is then introduced to the circulating water by positioning a treating chemical drum (not shown) proximate the chemical injection valve 52. A preferably one inch chemical transfer hose from the drum transfer pump (not shown) to the chemical injection valve 52 is connected and the injection valve 52 is opened to transfer the desired amount of treating solution into the cleaning tank 48. Once this is accomplished, the injection valve 52 is closed and the chemical transfer hose is disconnected.

Preferably, the treating solution is a combination of aqueous solutions of mineral acids such as hydrochloric, nitric, phosphoric, polyphosphoric, hydrofluoric, boric, sulfuric, sulfurous and the like. Aqueous solutions of organic acids have also been found to be useful as have aqueous mixtures of mineral and organic acids. Specific treating solutions useful with this invention are identified in previously discussed U.S. Pat. No. 5,360,488, which is hereby incorporated by reference, as well as U.S. Pat. Nos. 5,322,635 and 5,451,350, each of which are hereby incorporated by reference and disclose one to one ratio soap compositions.

After the appropriate treating solution is injected into the chemical tank 48 and the system is operating as described without any leaks at the appropriate pressures and flow rates, the treating solution is continued to be circulated in a first direction of arrow A through the pipe section 14 to clean sediment deposits and tuberculated growth within the pipe. The direction of arrow A for the initial circulation of the treating solution is the same as the direction of flow of the water through the pipe section 14 in use. In order to achieve optimum effectiveness and efficiency in cleaning the pipe section 14, periodically the flow direction of the treating solution is reversed in the pipe section 14 as follows. The bypass valve 64 on the chemical tank 48 is fully opened and the direction of the diversion valves 38, 40 are adjusted to thereby change the flow through the upstream stop valve 32 from discharge from the cleaning unit 10 to a return direction from the pipe section 14 and the direction of flow through the downstream stop valve 34 from return into the cleaning unit 10 to discharge from the cleaning unit 10 to the pipe section 14 to be cleaned. As a result, the flow direction in the pipe section 14 is in the direction of arrow B, opposite the original flow direction of arrow A and tuberculated nodules and other growth which is accumulated within the pipe section 14 are removed or broken off due to the more turbulent flow in the opposite direction from which they were formed. Specifically, when the flow of the treating solution is reversed in the pipe section 14 to the direction of arrow B which is opposite from the water flow direction when the pipe section is in use, tuberculated growth that has developed directionally with the typical flow direction in the pipe 14 is more easily broken off. Further, the flow direction has been reversed without disconnecting the cleaning unit 10 from the pipe section 14 thereby minimizing downtime of the water distribution network 12 and the labor required for the cleaning process. The system pressures and flow rates are again optimized by adjusting the bypass valve 64 from a fully open position toward a closed position. Monitoring each percentage of bypass valve 64 closure versus increase in flow rate through the discharge flow meter 46 enables an optimum flow rate to be achieved when there is no increase in flow rate as a result of continued bypass valve 64 closure. The direction of flow is preferably repeatedly reversed until the cleaning process in the pipe section 14 is completed.

During the cleaning process with treating solution flow in either direction, the cleaning process is monitored by various methods including discharge and return pressure and flow rates, specific gravity of the treating solution, consumption of the treating solution chemistry such as pH, conductivity or the like, changes in treating solution color and temperature. Further, all cleaning unit fittings as well as valves, pipes and associated components are continuously visually monitored for leakage along with any gain or loss of treating solution volume by monitoring the treating solution level indicator 50 on the chemical tank 48 and/or a sight gage. Further, changes in relative discharge and return flow rates between the meters 46, 42 is also an indication of any gain or loss of any treating solution volume.

After the pipe section 14 is cleaned, the treating solution is displaced by closing the downstream stop valve 34. The return, bypass, suction and upstream stop valves 44, 64, 58, 32 are all in opened positions. The upstream diversion valve 38 is positioned as return flow from the upstream direction and the downstream diversion valve 40 is positioned as return flow from the downstream direction. The upstream isolation valve 18 is opened allowing water from the distribution network 12 to displace the treating solution in the upstream circulation hose 24 and the cleaning unit valves and piping and flow into the chemical tank 48. Preferably the pH of the displaced treating solution is monitored at the flanged swivel adapter 28 on the upstream stop valve 32 until the desired pH reading is achieved. The upstream stop valve 32 and the upstream valve 16 are then closed and the downstream stop valve 34 is opened allowing the system water to flow through the clean pipe section 14 and thereby displacing the treating solution through the downstream circulation hose 26 and the downstream portion of the mobile cleaning unit valves and piping and into the cleaning tank 48. The flow is monitored until the pH at the flange swivel adapter 30 has returned to the desired pH level at which time the downstream stop valve 34 and the downstream valve 20 are closed. The downstream isolation valve 22 is then opened placing the clean pipe section 14 back into service.

Once the treating solution is displaced from the pipe section 14, it is preferably neutralized and then discharged. To do so, the pump 56 is started thereby circulating the spent treating solution through the mobile cleaning unit 10, valves and chemical tank 48. During the circulation of the spent solution drums of neutralizing solution (not shown) are positioned near the injection valve 52 on the chemical tank 48 and the chemical transfer hose from the drum transfer pump (not shown) to the valve is connected. The injection valve 52 is opened to transfer the neutralizing solution into the chemical tank 48 until the desired pH of the fluid in the chemical tank 48 is achieved. The injection valve 52 is then closed and the chemical transfer hose disconnected. A disposal transfer hose (not shown) is connected to the dump valve 36 to discharge the neutralized treating solution into a predetermined disposal waste stream. The pump 56 is turned off and the drain valve 54 is then opened to empty the balance of the neutralized treating solution from the chemical tank 48 to the waste stream. Once this is accomplished, the circulation hoses 24, 26 are disconnected from the upstream and downstream valves 16, 20 and the flanged swivel adapters 28, 30 and the hoses are rewound onto the hose reels. Preferably, any sediment in the chemical tank 48 is flushed with fresh water from the water tanks (not shown) through the drain valve 54 to a waste stream and the cleaning process is now completed.

Figure 2:
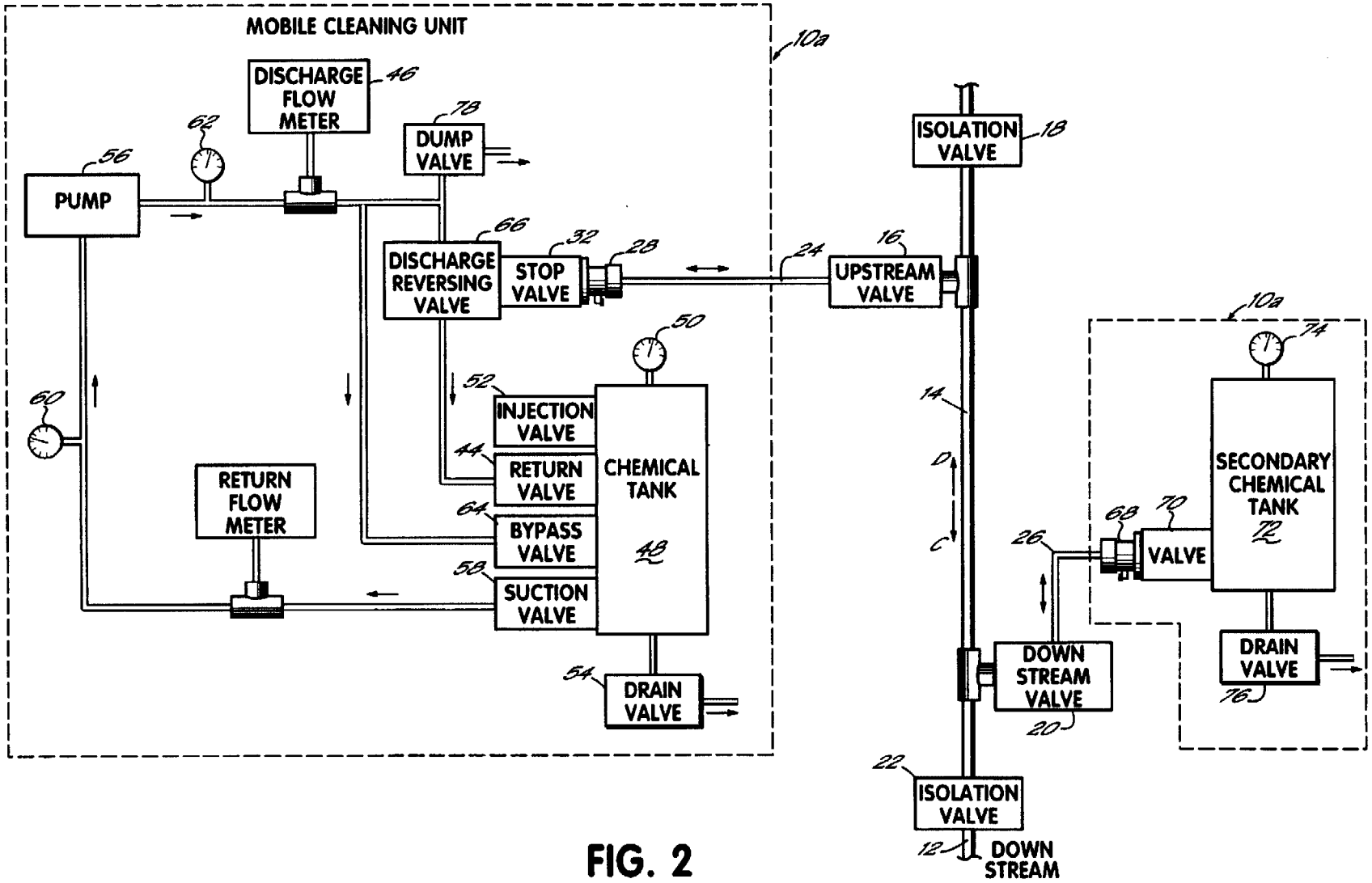
FIG. 2 is a second presently preferred embodiment of such a system.

A second presently preferred configuration of the mobile cleaning unit **10*a* according to this invention is shown in FIG. 2. The mobile cleaning unit 10*a* as shown in FIG. 2 is divided, for purposes of illustration only, into two separate sections, but it will be appreciated by one of ordinary skill in the art that the components of each section can be contained on a single flatbed truck (not shown) or the like for transportation thereof. The components shown in FIG. 2 which have corresponding counterparts to the embodiment shown in FIG. 1 are identified with the same reference numerals and it will be appreciated that the preferred components identified with reference to FIG. 1 are preferably also used with the embodiment of FIG. 2. The upstream circulation hose 24 is connected through the flanged swivel adapter 28 to the upstream stop valve 32 directly to a discharge reversing valve 66 which is adjustable between a return position for flow from the pipe section 14 into the cleaning unit 10*a* and a discharge position for flow from the cleaning unit 10a to the pipe section 14. Preferably the discharge reversing valve 66 is a three way, 3 inch valve with wrench and lock-out capability and an auxiliary port. Such a valve is available from Xomox Corporation as Part No. 031 AX DI/PFA. The downstream valve 20 is connected to the downstream circulation hose 26 to a flanged swivel adapter 68 on a valve 70 which is mounted on a secondary chemical tank 72. The secondary chemical tank 72 includes a level indicator 74 and a drain valve 76 similar to the chemical tank 48. Optionally, the secondary chemical tank 72 and valve 70 and components may be mounted only on an auxiliary trailer (not shown) for independent transportation from the chemical tank 48, pump 56 and other components of the mobile cleaning unit 10a which are connected to the upstream valve 16**.

After the upstream and downstream circulation hoses 24, 26 are connected to the respective valves 16, 20 on opposing ends of the pipe section 14 to be cleaned, the unit 10a is charged with water from the distribution network 12 by closing the downstream valve 20, injection valve 52, a dump valve 78, the drain valve 54 on the chemical tank 48, the valve 70 on the secondary chemical tank 72, and drain valve 76 on the secondary chemical tank 72. The upstream, bypass and suction valves 16, 64, 58 and upstream stop valve 32 are all opened and the discharge reversing valve 66 is positioned for return flow into the mobile cleaning unit 10a from the upstream direction. When the upstream valve 16 is opened, water from the distribution network 12 enters the upstream circulation hose 24 to displace the air and fill the hose 24 and other components of the cleaning unit connected thereto. The water flows through the mobile cleaning unit 10a and fills the chemical tank 48. Once the chemical tank 48 reaches an appropriate level, the upstream stop valve 32 is closed and the downstream valve 20 and valve 70 on the secondary chemical tank 72 are opened allowing water to flow through the pipe section 14 and into the downstream circulation hose 26 to fill the secondary chemical tank 72. The flow is continued until the desired water level in the secondary chemical tank 72 is achieved.

The system is isolated from the remainder of the water distribution network 12 and checked for leaks by closing the upstream and downstream isolation valves 18, 22 and positioning the discharge reversing valve 66 as discharge from the mobile cleaning unit 10a to the pipe section 14. With the bypass valve 64 and the return valve 44 closed, the circulation pump 56 is started and water is pumped from the chemical tank 48 through the mobile cleaning unit valves and piping system and upstream stop valve 32 into the upstream circulation hose 24 and through the pipe section 14 to be cleaned. The water flows in a first direction indicated by arrow C through the pipe section 14 and into the downstream valve 20 and through the downstream circulation hose 26 and into the secondary chemical tank 72 until air is purged from the system. The valve 70 on the secondary chemical tank 72 is then closed and pressure on the system is maintained at a level no greater than the normal operating pressure of the water distribution network 12 and the pipe section 14 to be cleaned by adjusting the bypass valve 64 from a full open position toward a closed position as previously described. After the desired pressure is attained, all valves, fittings and other components are checked for leakage as well as the level in the chemical tanks 48, 72 being monitored for any change for a minimum of 30 minutes. If leakage or any change in the fluid level in the chemical tanks 48, 72 can be determined, the system pressure is released and appropriate repairs are made and the system reevaluated.

The treating solution is injected into the chemical tank 48 through the injection valve 52 as previously described with reference to the first preferred embodiment shown in FIG. 1. The treating solution is connected via a chemical transfer hose (not shown) through the injection valve 52 and pumped into the chemical tank 48 and then the chemical transfer hose is disconnected and the injection valve 52 closed. The upstream stop valve 32 and the bypass valve 64 are opened with the pump 56 turned on to mix the treating solution in the chemical tank 48. The treating solution surges through the pipe section 14 in a first direction indicated by arrow C by opening the upstream and downstream valves 16 and 20, the upstream stop valve 32, and the valve 70 on the secondary chemical tank 72 and positioning the discharge reversing valve 66 for discharge from the pump 56 to the pipe section 14. Once again, the cleaning process is monitored as previously described. Periodically and repeatedly the flow direction of the treating solution in the pipe section 14 is reversed in order to achieve a more effective and complete cleaning of the pipe section 14. The treating solution flow direction is reversed when the treating solution in the chemical tank 48 or the secondary chemical tank 72 reaches a predetermined minimum volume as detected by the level indicators 50, 74. The treating solution flow direction is reversed by changing the discharge reversing valve 66 from a discharge orientation to a return orientation and opening the return valve 44 and closing the suction valve 58. As a result, the treating solution flows from the secondary chemical tank 72 in the direction of arrow D through the pipe section 14 and into the chemical tank 48. The flow reversal process is repeated until the cleaning process of the pipe section 14 is completed. Advantageously, the flow reversal is accomplished without disconnecting the mobile cleaning unit components from the pipe section 14 or water distribution network 12.

After the cleaning process is completed, the treating solution is displaced in the following manner. Preferably, the bulk of the treating solution is contained in the chemical tank 48 and the downstream valve 20 on the secondary chemical tank 72, the drain valve 76 on the secondary chemical tank 72, the injection valve 52 and the drain valve 54 on the chemical tank 48 are all in the closed position and the upstream 16, bypass 64, suction 58 and upstream stop 32 valves are all in an open position. The upstream isolation valve 18 is opened allowing water from the distribution network 12 to displace the spent treating solution in the upstream circulation hose 24 and into the mobile cleaning unit valves and piping and ultimately the chemical tank 48. The pH of the displaced solution is monitored at the flanged swivel adapter valve 28 on the upstream stop valve 32 until the desired pH reading is achieved. The upstream valve 16, upstream stop valve 32 and downstream isolation valve 22 are closed and the downstream valve 20 and the valve 70 on the secondary chemical tank 72 and the upstream isolation valve 18 are opened allowing water from the distribution network 12 to flow through the clean pipe section 14 and displace the treating solution in the downstream circulation hose 26 and valves connected to the secondary chemical tank 72. The flow is monitored at the flanged swivel adapter 68 on the valve 70 at the secondary chemical tank 72 until the desired pH level is achieved. The downstream valve 20 and the upstream isolation valves 18 are then closed. The downstream circulation hose 26 is then disconnected at the flanged swivel adapter 68 and the secondary chemical tank 72 and associated components are transported to the chemical tank 48, if appropriate, and the contents of the secondary chemical tank 72 are transferred into the chemical tank 48.

The spent treating solution is then neutralized and disposed of by starting the circulation pump 56 and circulating the spent treating solution through the mobile cleaning unit piping system, valves and chemical tank 48. While circulating the solution in this manner, the neutralization solution is injected into the chemical tank 48 through the injection valve 52 until the desired pH of the fluid in the chemical tank 48 is achieved. With the pump 56 operating, the dump valve 78 is then opened and appropriate transfer hoses connected to the dump valve 78 and the neutralized treating solution in the chemical tank 48 and mobile cleaning unit 10*a* is discharged to an appropriate waste stream and the pump 56 is shut down. The circulation hoses 24, 26 are then disconnected from the respective flanged swivel adapters 28, 68 as well as the upstream and downstream system valves 16, 20 and if necessary any sediment in the chemical tank 48 is flushed with fresh water and discharged therefrom through the drain valve 54. The circulation hoses are then wound onto the reels and the cleaning process is now complete according to the second preferred embodiment of this system.

Figure 3:
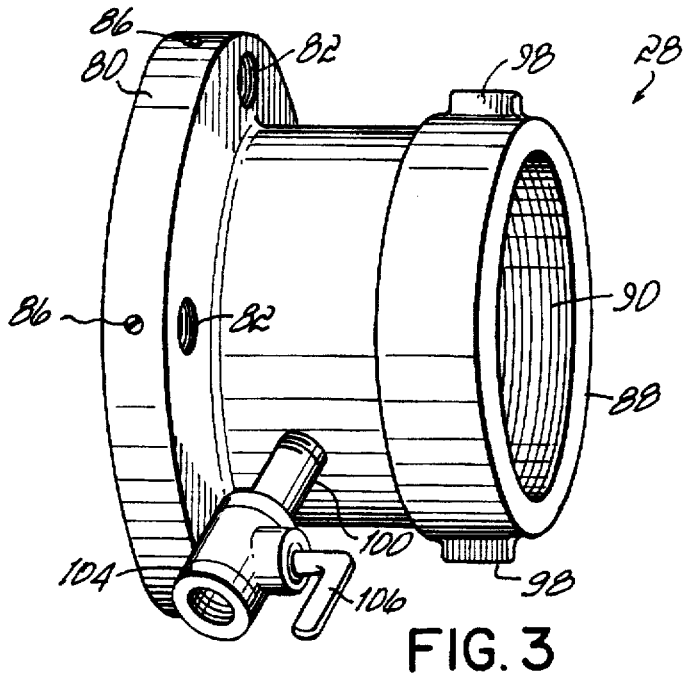
FIG. 3 is a perspective view of a presently preferred embodiment of a flanged swivel adapter which is used in the cleaning system of this invention.
Figure 4:
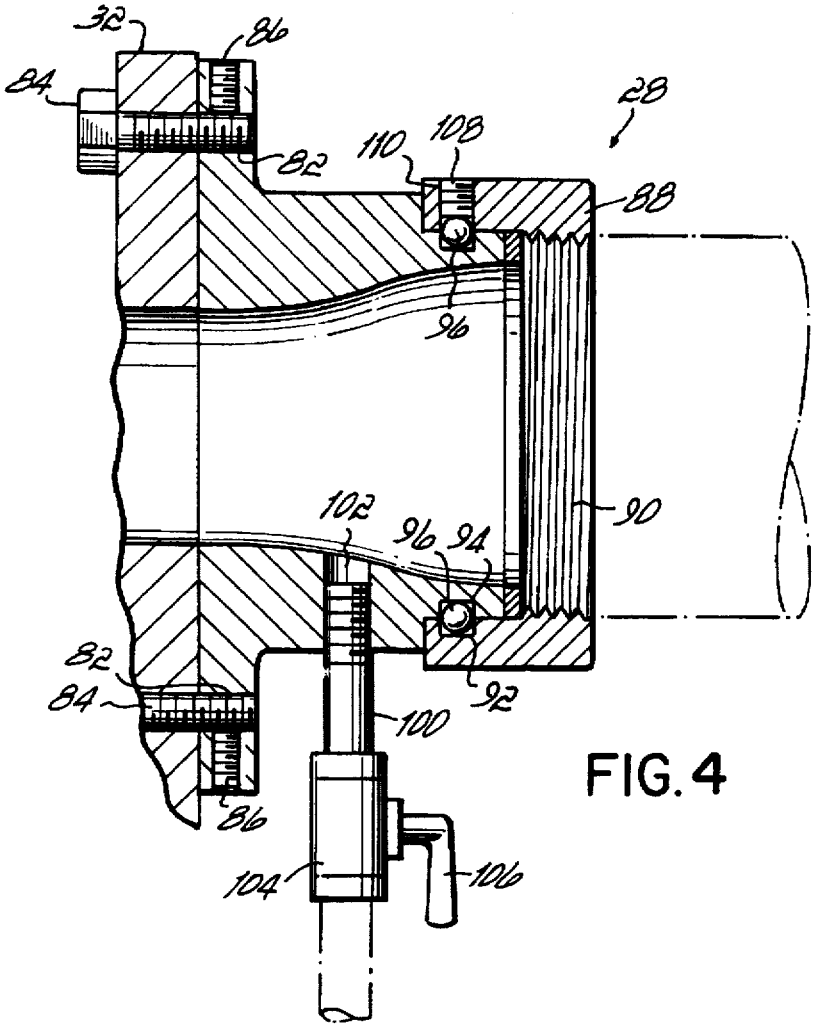
FIG. 4 is a cross-sectional view of the adapter shown in FIG. 3.

A presently preferred embodiment of the flanged swivel adapter 28, 30 or 68 used in the mobile cleaning unit 10 or 10*a* according to this invention is shown in FIGS. 3 and 4. The adapter 28 is preferably a concentric reducer to increase or decrease the cross-sectional area of the flow path of the solution therethrough depending on the flow direction. Preferably, the adapter 28 changes the flow path from a three inch diameter to a four inch diameter for a more laminar flow through the adapter 28.

The adapter 28 includes a base flange 80 having a plurality of threaded or tapped holes 82 therein for securing the adapter to a valve or other component as required with bolts, screws 84 or other preferably threaded fasteners. Advantageously, the adapter 28 and preferably all other connections between the components in the mobile cleaning unit 10 or 10*a* are made between mating flanges thereby minimizing, if not eliminating, threaded connections which are exposed to the treating solution within the mobile cleaning unit which may erode or deteriorate after prolonged contact with the treating solution or other chemicals. In a presently preferred embodiment, the flange 80 on the adapter 28 is sized to fit a 3 inch class 150 valve and the holes 82 are drilled and tapped through with one-half inch number 13 bolts. The connection between the adapter 28 and an adjacent member of the cleaning unit 10 or 10*a* such as the upstream stop valve 32 (FIGS. 1 and 4) for example, is accomplished by inserting each bolt 84 through a hole on the stop valve 32 and into one of the threaded holes 82 on the adapter flange 80. Rotation of the bolt 84 enables the threads on the bolt 84 to mesh with the threads in the hole 82 and draw the adapter 28 and stop valve 32 together forming a tight seal therebetween. A set screw 86 may be inserted into a tap hole to secure the bolts 84 connecting the flange 80 to the adjacent valve 32 or other component and inhibit loosening of the connection as a result of vibration or the like.

An upper collar 88 is rotatably mounted on an end of the adapter 28 opposite the flange 80. The inner circumference of the collar 88 has threads 90 machined thereon for a 4 inch navy thread connection for connecting with the circulation hoses 26 or 24. A circumferential race 92 is formed proximate the lower inner edge of the collar 88 and mates with a corresponding race 94 on the adapter body to capture a plurality of preferably one-quarter inch brass balls 96 which enable the rotation of the collar 88 relative to the adapter body for coupling the circulation hoses 24, 26 thereto. Tabs 98 are provided on the outer surface of the collar 88 to facilitate easy rotation thereof. A set screw 108 is threadably positioned in a hole 110 in the collar 88 to capture the balls 96 in the race 94 which have been inserted therein through the hole 110. Preferably, the adapter 28 and other components of the mobile cleaning unit 10 or 10*a* are fabricated from acid resistant materials such as brass or the like.

Preferably, a bleed line 100 is threadably secured through an aperture 102 between the flange 80 and the collar 88 on the body of the adapter 28. The bleed line 100 is preferably one-quarter inch brass and includes a quarter inch brass ball valve 104 with brass ball and teflon seat (not shown) but could be an elbow valve or other component within the scope of this invention. The valve 104 is operable between the open and closed position by a pivotal handle 106 projecting upwardly therefrom. The bleed line 100 and valve 104 are advantageously provided to remove a portion of the fluid flowing through the adapter 28 in the mobile cleaning unit 10 or 10*a* for testing, analysis or the like without disruption, disconnection, or interruption of the cleaning operation of the pipe section 14.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A system for cleaning a pipe section of a water distribution network comprising:

a tank adapted to hold a chemical treating solution;

a pump connected to the tank for circulating the treating solution and water from the distribution network into and from the tank;

an upstream diversion valve being connected to an upstream end of the pipe section and being adjustable between a discharge position permitting flow from the system to the upstream end of the pipe section and a return position permitting flow from the upstream end of the pipe section to the system; and a downstream diversion valve being connected to a downstream end of the pipe section and being adjustable between a discharge position permitting flow from the system to the downstream end of the pipe section and a return position permitting flow from the downstream end of the pipe section to the system;

wherein the treating solution can be circulated in a first direction through the pipe section when the upstream and downstream diversion valves are in the discharge and return positions, respectively, and the treating solution can be circulated in a second direction through the pipe section opposite from the first direction when the upstream and downstream diversion valves are in the return and discharge positions, respectively, so that the treating solution is circulated in a closed-loop path through the system and the pipe section in the first and second directions for increased cleaning effectiveness to remove scale and other sediment within the pipe section.

2. The system of claim 1 further comprising:

a vehicle upon which the system is mounted for transportation.

3. The system of claim 1 further comprising:

an upstream stop valve operably connected between the upstream diversion valve and the upstream end of the pipe section; and an downstream stop valve operably connected between the downstream diversion valve and the downstream end of the pipe section, each said stop valve being adjustable between open and closed positions which permit and prevent, respectively, flow therethrough.

4. The system of claim 1 wherein the direction of the circulation of the treating solution is reversed between the first and second directions without disconnecting the system from the pipe section.

5. A system for cleaning a pipe section of a water distribution network comprising:

a tank adapted to hold a chemical treating solution;

a pump connected to the tank for circulating the treating solution and water from the distribution network into and from the tank;

an upstream diversion valve being connected to an upstream end of the pipe section and being adjustable between a discharge position permitting flow from the system to the upstream end of the pipe section and a return position permitting flow from the upstream end of the pipe section to the system;

a downstream diversion valve being connected to a downstream end of the pipe section and being adjustable between a discharge position permitting flow from the system to the downstream end of the pipe section and a return position permitting flow from the downstream end of the pipe section to the system;

wherein the treating solution can be circulated in a first direction through the pipe section when the upstream and downstream diversion valves are in the discharge and return positions, respectively, and the treating solution can be circulated in a second direction through the pipe section opposite from the first direction when the upstream and downstream diversion valves are in the return and discharge positions, respectively, for increased cleaning effectiveness to remove scale and other sediment within the pipe section; and a bypass line connected between the chemical tank and the pump;

a bypass valve operably connected on the bypass line and permitting flow from the pump to the tank, the bypass valve being adjustable to and between an open position and a closed position to permit adjustment of pressure and flow rates within the system.

6. A system for cleaning a pipe Section of a water distribution network comprising:

a tank adapted to hold a chemical treating solution;

a pump connected to the tank for circulating the treating solution and water from the distribution network into and from the tank;

an upstream diversion valve being connected to an upstream end of the pipe section and being adjustable between a discharge position permitting flow from the system to the upstream end of the pipe section and a return position permitting flow from the upstream end of the pipe section to the system; and a downstream diversion valve being connected to a downstream end of the pipe section and being adjustable between a discharge position permitting flow from the system to the downstream end of the pipe section and a return position permitting flow from the downstream end of the pipe section to the system;

wherein the treating solution can be circulated in a first direction through the pipe section when the upstream and downstream diversion valves are in the discharge and return positions, respectively, and the treating solution can be circulated in a second direction through the pipe section opposite from the first direction when the upstream and downstream diversion valves are in the return and discharge positions, respectively, for increased cleaning effectiveness to remove scale and other sediment within the pipe section;

an upstream stop valve operably connected between the upstream diversion valve and the upstream end of the pipe section; and a downstream stop valve operably connected between the downstream diversion valve and the downstream end of the pipe section, each said stop valve being adjustable between open and closed positions which permit and prevent, respectively, flow therethrough.

a flanged swivel adaptor on each of the stop valves, each said adaptor having a flange on a first end coupled to the stop valve and a threaded collar rotatably mounted on a second end and threadably coupled to a tubular member in communication with the pipe section.

7. The system of claim 6 further comprising:

a bleed line projecting from each adaptor to divert a portion of the fluid flowing through each adaptor;

a valve on the bleed line being adjustable to and between a closed position and an open position which permit and prevent, respectively, flow through the valve.

8. The system of claim 6 wherein said adapter adjusts a flow path cross-sectional area between said first end and said second end.

9. A system for cleaning a pipe section of a water distribution network comprising:

a tank adapted to hold a chemical treating solution;

a pump connected to the tank for circulating the treating solution and water from the distribution network into and from the tank;

an upstream diversion valve being connected to an upstream end of the pipe section and being adjustable between a discharge position permitting flow from the system to the upstream end of the pipe section and a return position permitting flow from the upstream end of the pipe section to the system;

a downstream diversion valve being connected to a downstream end of the pipe section and being adjustable between a discharge position permitting flow from the system to the downstream end of the pipe section and a return position permitting flow from the downstream end of the pipe section to the system;

wherein the treating solution can be circulated in a path through the system and the pipe section in a first direction when the upstream and downstream diversion valves are in the discharge and return positions, respectively, and the treating solution can be circulated in a path through the system and the pipe section in a second direction opposite from the first direction when the upstream and downstream diversion valves are in the return and discharge positions, respectively, without disconnecting the system from the pipe section, the circulation of the solution in the first and second directions increasing the cleaning effectiveness of the system to remove scale and other sediment within the pipe section;

a bypass line connected between the chemical tank and the pump;

a bypass valve operably connected on the bypass line and permitting flow from the pump to the tank, the bypass valve being adjustable to and between an open position and a closed position to permit adjustment of pressure and flow rates within the system;

an upstream stop valve operably connected between the upstream diversion valve and the upstream end of the pipe section;

an downstream stop valve operably connected between the downstream diversion valve and the downstream end of the pipe section, each said stop valve being adjustable between open and closed positions which permit and prevent, respectively, flow therethrough; and a vehicle upon which the system is mounted for transportation.

10. The system of claim 9, further comprising:

a flanged swivel adaptor on each of the stop valves, each said adaptor having a flange on a first end coupled to the stop valve and a threaded collar rotatably mounted on a second end and threadably coupled to a tubular member in communication with the pipe section, wherein said adapter adjusts a flow path cross-sectional area between said first end and said second end;

a bleed line projecting from each adaptor to divert a portion of the fluid flowing through each adaptor; and a valve on the bleed line being adjustable to and between a closed position and an open position which permit and prevent, respectively, flow through the valve.

11. A system comprising:

a pipe section of a water distribution network;

a primary tank and a secondary tank each being adapted to hold a chemical treating solution;

a pump connected to the primary tank for circulating the treating solution and water from the distribution network into and from each of the tanks;

a reversing valve being connected to one end of the pipe section and being adjustable between a discharge position permitting flow from the primary tank to the pipe section and a return position permitting flow from the pipe section to the primary tank system;

a valve connected to another end of the pipe section and being adjustable between an open position permitting flow between the pipe section and the secondary tank and a closed position inhibiting flow between the pipe section and the secondary tank;

wherein the treating solution can be circulated in a first direction through the pipe section when the reversing valve is in the discharge position and the treating solution can be circulated in a second direction through the pipe section opposite from the first direction when the reversing valve is in the return position for increased cleaning effectiveness to remove scale and other sediment within the pipe section.

12. The system of claim 11 wherein the direction of the circulation of the treating solution is reversed between the first and second directions without disconnecting the system from the pipe section.

13. A system for cleaning a pipe section of a water distribution network comprising:

a primary tank and a secondary tank each being adapted to hold a chemical treating solution;

a pump connected to the primary tank for circulating the treating solution and water from the distribution network into and from each of the tanks;

a reversing valve being connected to one end of the pipe section and being adjustable between a discharge position permitting flow from the primary tank to the pipe section and a return position permitting flow from the pipe section to the primary tank system;

a valve connected to another end of the pipe section and being adjustable between an open position permitting flow between the pipe section and the secondary tank and a closed position inhibiting flow between the pipe section and the secondary tank;

wherein the treating solution can be circulated in a first direction through the pipe section when the reversing valve is in the discharge position and the treating solution can be circulated in a second direction through the pipe section opposite from the first direction when the reversing valve is in the return position for increased cleaning effectiveness to remove scale and other sediment within the pipe section;

a first flanged swivel adaptor between the reversing valve and the pipe section and a second flanged swivel adaptor between the secondary tank and the pipe section, each said adaptor having a flange on a flange on a first end and a threaded collar rotatably mounted on a second end and threadably coupled to a tubular member in communication with the pipe section;

a bleed line projecting from each adaptor to divert a portion of the fluid flowing through each adaptor; and a valve on the bleed line being adjustable to and between a closed position and an open position which permit and prevent, respectively, flow through the valve.

14. A cleaning system comprising:

a pipe section of a water distribution network, the pipe section having an upstream end and a downstream end;

a tank adapted to hold a chemical treating solution;

a pump connected to the tank for circulating the treating solution and water from the pipe section into and from the tank;

an upstream diversion valve being connected to the upstream end of the pipe section and being adjustable between a discharge position permitting flow from the system to the upstream end of the pipe section and a return position permitting flow from the upstream end of the pipe section to the system; and a downstream diversion valve being connected to the downstream end of the pipe section and being adjustable between a discharge position permitting flow from the system to the downstream end of the pipe section and a return position permitting flow from the downstream end of the pipe section to the system;

wherein the treating solution can be circulated in a first direction through the pipe section when the upstream and downstream diversion valves are in the discharge and return positions, respectively, and the treating solution can be circulated in a second direction through the pipe section opposite from the first direction when the upstream and downstream diversion valves are in the return and discharge positions, respectively, for increased cleaning effectiveness to remove scale and other sediment within the pipe section.

15. The cleaning system of claim 14 further comprising:

a bypass line connected between the chemical tank and the pump; and a bypass valve operably connected on the bypass line and permitting flow from the pump to the tank, the bypass valve being adjustable to and between an open position and a closed position to permit adjustment of pressure and flow rates within the system.

16. The cleaning system of claim 14 further comprising:

an upstream stop valve operably connected between the upstream diversion valve and the upstream end of the pipe section; and a downstream stop valve operably connected between the downstream diversion valve and the downstream end of the pipe section, each said stop valve being adjustable between open and closed positions which permit and prevent, respectively, flow therethrough.

* * * * *